United States Patent [19]

Shanklin et al.

[11] Patent Number: 4,974,744

[45] Date of Patent: Dec. 4, 1990

[54] HOLDER FOR ULTRA-PASTEURIZED DRINK CARTON

[75] Inventors: Donald J. Shanklin, Fullerton; William J. Segal, Torrance; Martin A. Spiegel, Diamond Bar, all of Calif.; William Kovensky, Columbia, Md.

[73] Assignee: TDJ, Inc., Diamond Bar, Calif.

[21] Appl. No.: 423,246

[22] Filed: Oct. 18, 1989

[51] Int. Cl.[5] ..... B65D 17/44

[52] U.S. Cl. ..... 220/278; 220/254; 220/375; 220/85 H; 220/90.2; 222/183; 222/83

[58] Field of Search ..... 220/85 H, 254, 375, 220/90.4, 90.2, 278, 277; 222/81, 83, 130, 131, 183, 538, 530

[56] References Cited

U.S. PATENT DOCUMENTS

| | | | |
|---|---|---|---|
| D. 157,128 | 2/1950 | Collinet . | |
| D. 167,214 | 4/1952 | Lapin . | |
| D. 167,254 | 7/1952 | Cherry . | |
| D. 173,198 | 10/1954 | Glauber . | |
| D. 186,555 | 11/1958 | Hunt . | |
| D. 270,029 | 8/1983 | McLean . | |
| 979,072 | 12/1910 | Javins | 220/278 |
| 1,033,643 | 7/1912 | Weislowits et al. . | |
| 1,149,840 | 8/1915 | Lange | 220/278 |
| 1,240,029 | 9/1917 | Darley . | |
| 1,284,822 | 11/1918 | Tumey | 222/538 |
| 1,599,967 | 9/1926 | Johnson . | |
| 1,600,055 | 9/1926 | Meyer . | |
| 1,863,853 | 6/1932 | Jackson | 220/278 |
| 1,927,258 | 9/1933 | Dailey | 220/278 |
| 1,935,969 | 11/1933 | Witherspoon | 220/278 |
| 2,126,667 | 8/1938 | Russell | 220/278 |
| 2,203,911 | 6/1940 | Krafty | 220/278 |
| 2,212,340 | 8/1948 | Davis . | |
| 2,359,797 | 10/1944 | Schider . | |
| 2,501,653 | 3/1950 | Boak | 220/278 |
| 2,600,911 | 6/1952 | Olson . | |
| 2,687,157 | 8/1954 | Cowan . | |
| 2,787,397 | 4/1957 | Radford . | |
| 2,868,411 | 1/1959 | Kesselman . | |
| 2,921,706 | 1/1960 | Johnson . | |
| 2,932,423 | 4/1960 | Baumgartner . | |
| 2,936,927 | 5/1960 | Peters . | |
| 2,958,444 | 3/1958 | Rhoe . | |
| 3,000,536 | 6/1959 | Roy . | |
| 3,090,478 | 8/1960 | Stanley . | |
| 3,186,574 | 12/1962 | Davidson . | |
| 3,223,275 | 12/1965 | Rice . | |
| 3,240,375 | 11/1963 | Burrows . | |
| 3,257,025 | 6/1966 | Jolly | 222/183 |
| 3,373,897 | 3/1968 | Haines . | |
| 3,405,836 | 10/1968 | Regis, Jr. . | |
| 3,651,983 | 3/1972 | Haugen . | |
| 3,688,895 | 9/1972 | Wilson . | |
| 3,737,067 | 6/1973 | Palson . | |
| 3,899,073 | 8/1975 | Barr . | |

(List continued on next page.)

FOREIGN PATENT DOCUMENTS

| | | | |
|---|---|---|---|
| 2062396 | 9/1971 | Fed. Rep. of Germany | 220/85 H |
| 2624486 | 12/1977 | Fed. Rep. of Germany | 220/254 |
| 3717898 | 8/1988 | Fed. Rep. of Germany . | |
| 862235 | 12/1939 | France . | |
| 1467258 | 12/1965 | France . | |
| 484519 | 5/1938 | United Kingdom . | |

OTHER PUBLICATIONS

Sip-Eze commercial product photographs.

*Primary Examiner*—George E. Lowrance
*Assistant Examiner*—S. Castellano
*Attorney, Agent, or Firm*—Roylance, Abrams, Berdo & Goodman

[57] ABSTRACT

A holder for a drink carton, which holder includes a main housing, a lid member coupled to the main housing, and a stopper member coupled to the lid. The lid includes a first aperture that receives a first end of the stopper member and a second aperture that provides access to a drink box container in the holder so that the opening of the drink box can be punctured and stoppered by means of the second end of the stopper member.

7 Claims, 3 Drawing Sheets

U.S. PATENT DOCUMENTS 3,905,511 9/1975 Groendal ..... 220/90.2
4,102,452 7/1978 Sato et al. .
4,133,449 1/1979 Ostrowsky .
4,148,418 4/1979 Ewing ..... 220/85 H
4,203,528 5/1980 Hasegawa .
4,212,386 4/1980 Maisonneuve .
4,245,685 1/1981 Nemitz et al. .
4,247,020 1/1981 Desjardin .
4,257,537 3/1981 Uhlig ..... 220/345
4,300,612 11/1981 Schroeder, Jr. et al. .
4,363,403 12/1982 Raucci, Jr. et al. .
4,505,404 3/1985 Perchank et al. .
4,518,092 5/1985 Contreras, Sr. .
4,550,813 11/1985 Browning .
4,561,560 12/1985 Lyon ..... 220/345
4,573,631 3/1986 Reeves .
4,576,306 3/1986 Kelsey ..... 220/375
4,703,853 11/1987 Byrns .
4,715,492 12/1987 Holmes .
4,723,689 2/1988 Vallos et al. .
4,730,731 3/1988 Allison .
4,733,794 3/1988 Kent .
4,733,796 3/1988 Halverstadt et al. .
4,746,017 5/1988 Howard et al. .
4,756,442 7/1988 Halm et al. .
4,801,035 1/1989 Sugiyama et al. .
4,838,466 6/1989 Holmstrom ..... 220/85 H
4,907,722 3/1990 Ueda et al. ..... 220/277

FIG. 5
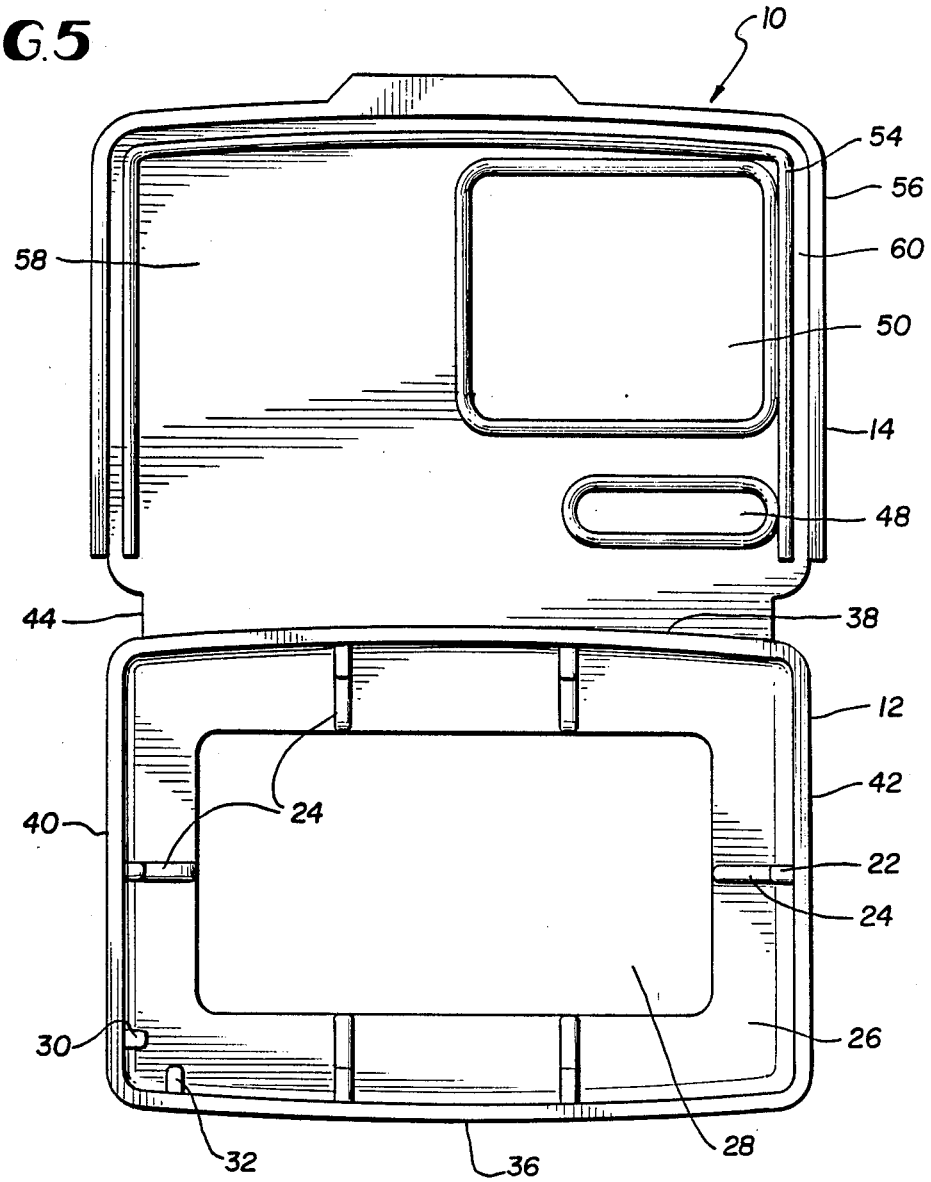
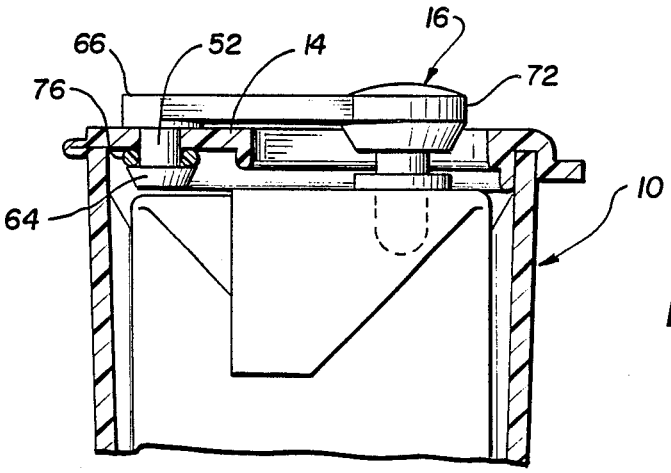
FIG. 6

HOLDER FOR ULTRA-PASTEURIZED DRINK CARTON

BACKGROUND OF THE INVENTION

This invention relates to a holder for a drink carton.

Milk, juice, lemonade and other drinks are commonly served in conventional single serving, ultra-pasteurized drink cartons or drink boxes. These boxes are generally of a standard size of approximately two and one half inches wide, four and one eighth inches high, and one and five eighths inches thick. They are also sold in other sizes, and the invention can be readily accommodated to such other sizes. Ultra-pasteurized beverage boxes of this type have become popular because they can store perishable liquids without a requirement of refrigeration until the box has been opened. In the commonly marketed size, they provide handy single serving containers suitable for children to carry to school in their lunch boxes or for businessmen to pack in their briefcases. The drink boxes are commonly provided with a sealed opening which can be pierced by a straw or other object to allow access to the liquid inside. The drink boxes are commonly sold with a drinking straw included.

Handy though it may be, the juice box has several disadvantages that restrict its usefulness. A first disadvantage is that the juice box cannot be conveniently resealed once it has been opened. There is consequently a risk of spilling if an opened but unsealed juice box whose contents have not been completely drunk is left lying around or is placed in a refrigerator where it can be inadvertently knocked over. Moreover, a conventional juice box or juice carton has the disadvantage of being easily squeezeable in such a manner that the contents of the juice box can be squirted out through the straw. Although this may be a source of amusement for children, cleaning up the consequent mess is a headache for grown-ups.

A second disadvantage of conventional juice boxes is that they do not provide a place for storing the drinking straw when the juice box is put away after partial use. Simply leaving the straw in the straw hole provided is undesirable because it is unwieldy and the exposed straw can pick up dirt or germs from the surrounding environment.

It is therefore desirable to have a carrier or holder for a conventional juice box that allows easy storage of the juice box when it is not being used. It is further desirable that the carrier be composed of material sufficiently rigid so that a person, especially a child, holding the carrier with the juice box inside cannot squeeze the sides of the juice box and cause the juice inside to squirt out. It is further desirable that the carrier or holder allow easy insertion and removal of a juice box. It is further desirable to have a carrier that permits the storage of the drinking straw within the interior of the carrier so that when the juice box is not in use, the straw is not exposed to an unsanitary environment.

It is also desirable that the carrier or holder have some means of initially puncturing the straw hole of the juice box and later stoppering it when the juice box is not being used. It is desirable that the stopper member used to accomplish the puncturing and stoppering be permanently attached to the drink box carrier so that it does not get lost and that it be affixed to the carrier in such a way that the stopper end can be moved to accommodate various straw hole positions of different juice boxes.

It has been found that a suitable holder for drink containers in accordance with the invention may be obtained by providing a rigid plastic carrier comprising a main housing, a lid member coupled to the housing, and having a first aperture for receiving a first end of a stopper member and a second aperture for providing access to the straw hole of a juice container when it is inside the housing. The invention includes a stopper member having a first end received in the first aperture and a second end releasably received in the second aperture. The second end of the stopper member can be used to puncture and seal the straw hole of a juice box placed inside the holder. The first end of the stopper member cooperates with the first aperture to allow the second end to be moved to accommodate various straw hole positions and to be moved out of the way when the juice box is being used.

A plurality of ribs in the interior of the main housing support the drink container and add strength to resist squeezing. One or more holes in the bottom of the housing facilitate insertion and removal of the juice box. Secondary ribs in one corner of the interior of the main housing serve to accommodate a straw.

The above and other features and advantages of the invention will be clear and will present themselves from the following detailed description when read in conjunction with the drawings also forming a part of this disclosure.

BRIEF DESCRIPTION OF THE DRAWINGS

FIG. 5 is a top view of the main housing and lid member of the drink carrier with the lid in a fully opened position; and FIG. 6 is a cross-sectional side view of the upper section of the carrier showing an alternative attachment of the stopper member to the lid member.

DETAILED DESCRIPTION OF THE PREFERRED EMBODIMENT

Figure 1:
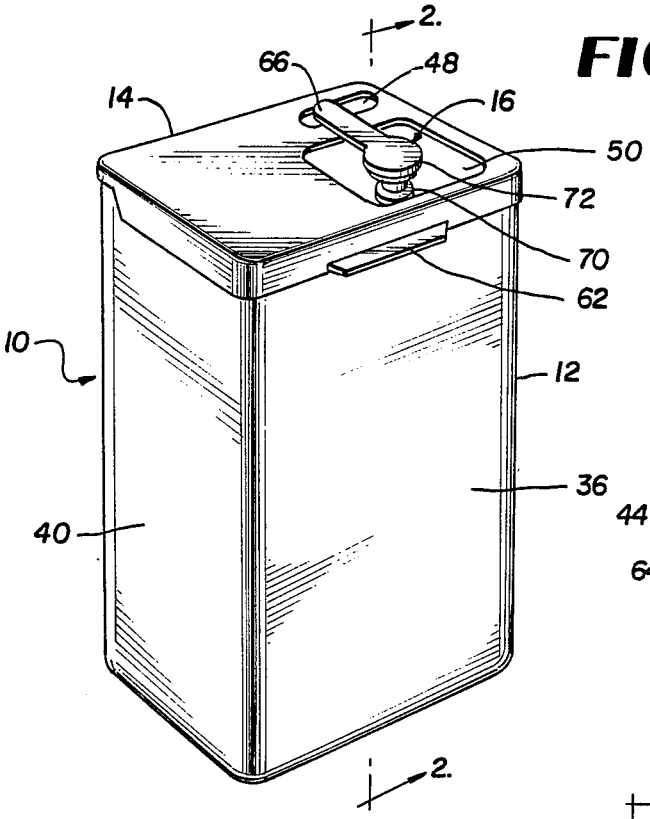
FIG. 1 is a perspective view of the carrier of the present invention showing the carrier lid in a closed position.

As used herein, the terms "beverage box", "juice box", "juice carton", "juice container", "drink box", "drink container", "drink carton", "box", "container", "carton" and the like all refer to a conventional single-serving ultra-pasteurized or aseptic container for juice, milk or other drinks.

Referring now to the drawings, the carrier 10 comprises a main housing 12, a lid member 14 coupled to the main housing 12, and a stopper member 16 removably coupled to the lid member 14. The carrier 10 is fabricated of a semirigid material, preferably a resilient plastic material that can be injection molded. The main housing 12 and lid member 14 are preferably molded simultaneously with an interconnecting integral "living hinge" 44. The stopper member 16 is molded separately and is attached to the lid member 14 subsequent to the molding operation. The main housing 12 is an approximately rectangular parallelepiped having a bottom 26, a front 36, a rear 38, and opposing sides 40 and 42, all integrally molded, and having a continuous top edge 74 surrounding a top open end 46. The main housing 12 includes an interior space 18 dimensioned to receive a conventional single serving ultra-pasteurized box of juice, milk or other drink. The standard size of these boxes is approximately two and one half inches wide, four and one eighth inches high, and one and five eighths inches thick. However, carriers to hold drink containers of other dimensions are also within the scope of this invention.

Figure 2:
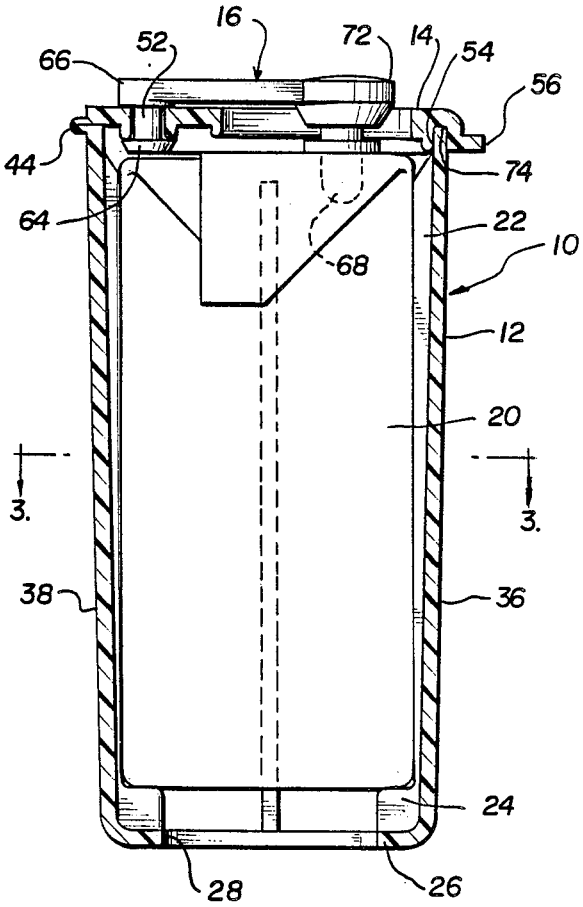
FIG. 2 is a cross-sectional side view taken on line 2—2 of FIG. 1 showing the lid in a closed position and the stopper member engaging the straw hole of a juice box.
Figure 3:
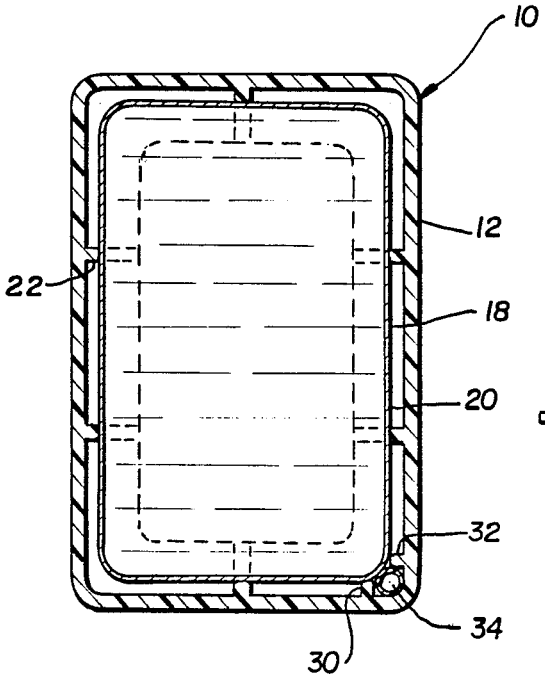
FIG. 3 is a cross-sectional top view of the carrier housing taken on line 3—3 of FIG. 2 showing a drink container and straw in place within the housing.

The interior of the housing 12 has a plurality of spaced, generally L-shaped, longitudinal ribs 22 positioned to support the drink box in the interior of the housing. The ribs each include a foot 24 for supporting the bottom of a drink box. As shown in FIG. 2 and FIG. 3, the ribs 22 define a space wherein the juice box 20 is held snugly within the main housing 12.

The bottom 26 has at least one hole 28 for facilitating the insertion and removal of a juice container into and out of the main housing. The hole 28 relieves air pressure or vacuum when the juice box 20 is inserted or removed. Preferably, the hole 28 should be large enough so that a finger (not shown) may be inserted through the bottom to facilitate removal of the juice box.

As shown in FIGS. 3 and 5, the interior of the main housing may be further provided with a pair of secondary ribs 30 and 32 located adjacent to each other and perpendicular to each other in a corner of the housing so that in cooperation with a corner of the housing they define a space that can encompass a drinking straw of the type that is normally included with a typical drink box. The drinking straw that normally accompanies the typical drink box is considerably smaller than a standard soda fountain drinking straw—the straw size is necessarily limited to what can be conveniently packaged and marketed with a drink box—and is most typically about four and one half inches in length and about five-thirty secondths inches in diameter. Also common is a longer straw that comprises two straight sections joined by an accordioned, flexible middle section, so that the straw can be folded back on itself. It will be readily understood that any one of the four corners formed by the intersection of a side 40 or 42 and front 36 or rear 38 can serve as the location of the secondary ribs 30 and 32. Since it is desirable that the carrier be sufficiently large so that a drinking straw can be contained within the housing when the lid is closed, sufficient height for this purpose is obtained by making the height of each foot 24 sufficiently great to give the main housing an overall height greater than the length of the drinking straw. By way of example, a carrier with a main housing with a height of between about four and one half inches and five inches would accommodate a straw that is four and one half inches long. A straw of the type with a flexible middle portion may be accommodated within the carrier by placing one straight section of the straw in the space provided and folding the straw so that the remaining sections of the straw fit between the juice box and the front, rear, opposing sides or lid member of the carrier.

As shown in FIG. 5, the front 36 and rear 38 may be slightly curved to provide strength to the front and rear, to resist squeezing of a juice container contained within the housing and to facilitate holding and carrying the carrier 10. Preferably, the front 36 and rear 38 each comprise a vertical plane curved convexly around a vertical axis with a radius of curvature of about 35 inches.

As shown in FIG. 2, the front, rear, and sides of the carrier 10 may slope inwardly from top to bottom to facilitate extraction of the carrier from the mold in which it is made.

Figure 4:
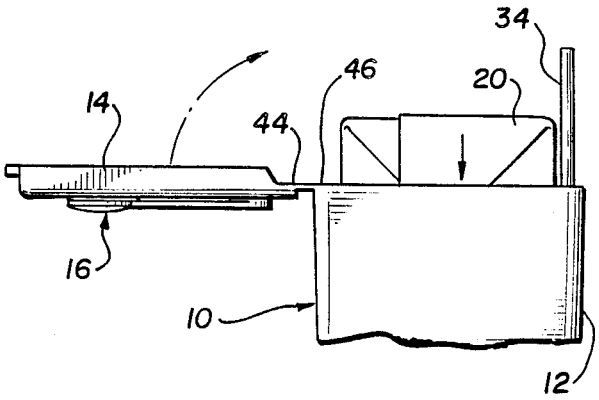
FIG. 4 is a side view of the upper section of the carrier with the lid in the open position and a drink container and straw in the process of being inserted into the housing.

The lid member 14 is molded simultaneously with the main housing 12 and is connected to the housing by an integral living hinge 44. The hinge allows the lid to be moved from an open position, as shown in FIGS. 4 and 5, to a closed position, as shown in FIGS. 1 and 2. The lid member 14 further has closure means for releasably holding the lid member in a closed position. Preferably, the closure means comprises a double wall formed of an inner wall 54 and an outer wall 56 extending around the perimeter of the underside 58 of the lid member 14, except on the side adjacent to the living hinge 44. The inner wall 54 and outer wall 56 together form a groove 60 that frictionally engages the top edge 74 of the front 36 and sides 40 and 42 of the main housing to firmly hold the lid in a closed position. The lid member 14 may be provided with one or more projections 62 to facilitate disengaging the lid member from its closed position.

The lid member has first and second apertures 48 and 50. The first aperture 48 receives the first end 66 of the stopper member 16. The second aperture 50 may be of any shape and is positioned to provide access to the orifice of a drink container when a drink container has been inserted into the main housing 12 and when the lid 14 is in a closed position. The stopper member 16 has a first end 66 having a cylindrical protuberance 52 having a flanged end 64. The first end 66 is configured so that the cylindrical protuberance 52 can be force fitted into the first aperture 48 of the lid member 14. The flanged end 64 prevents easy removal of the stopper member 16 from the lid member 14 after the two have been joined together. Preferably, the stopper protuberance 52 is force fitted into the first aperture 48 and is held in place by the flanged end 64 with sufficient strength so that the stopper member cannot be easily removed by a child. Since it is anticipated that the carrier would be used extensively by children, the product should meet or exceed any nationally recognized safety requirements for toys intended for use by children such as American National Standard ANSI/VPS 72–76. Alternatively, the stopper member 16 may be held in place by a washer 76 between the flanged end 64 of the cylindrical protuberance 52 and the underside 58 of the lid member 14, as shown in FIG. 6. The second end 72 of the stopper member 16 includes means for puncturing and sealing the orifice of a drink container 20. The puncturing and sealing means is preferably a shaft 68 extending downward from the second end 72 of the stopper member, the shaft being approximately the same diameter as the orifice 70 of the drink container. The first end of the stopper member 66 should be fitted in the first aperture 48 in such a way that the stopper member is given freedom to pivot. The first aperture 48 is preferably oblong in shape, having a principal axis, so that the stopper protuberance 52 can be moved from side to side within the first aperture in the direction of the principal axis and so that through the pivoting or moving of the first end 66 of the stopper member 16, the second end 72 of the stopper member 16 can be moved to various locations within the second aperture 50. With this freedom of movement, the second stopper end 72 can be moved into position to puncture the orifice 70 of a drink container 20 and then move out of the way so that a straw can be inserted into the orifice of the drink container. The freedom of movement of the stopper member 16 allows the user of the drink carrier to adjust for any small variations in the location of the straw orifice 70 from one drink carton to another.

In operating the drink container carrier, a user opens the lid 14, inserts a drink carton 20 so that the orifice 70 provided for inserting a straw faces the open end of the housing 12 and so that the orifice is on the same side of the carrier 10 as the second aperture 50. The user then closes the lid 14 so that the groove 60 formed by the inner wall 54 and outer wall 56 of the lid 14 frictionally engages the upper edge 79 of the front 36 and sides 40 and 42. The user may then use either the stopper member 16 or the straw provided with the container to puncture the orifice of the container and may then insert the straw and begin drinking the beverage contained within the drink carton. If the user desires to store the drink for later use before the container has been emptied, the user removes the straw, opens the lid 14 and slides the straw into the space in the interior of the main housing defined by secondary ribs 30 and 32. The user then closes the lid and then positions the stopper member 16 so that the shaft 68 can be inserted into the straw orifice 70 thereby sealing the drink container.

While the invention has been described in some detail above, it is to be understood that this detailed description is by way of example only, and the protection granted is to be limited only by the spirit of the invention and the scope of the following claims.

What is claimed is:

1. A carrier for holding a drink container, the drink container having a parallelepiped shape with a top having a sealed punctuable orifice, said carrier comprising:

a main housing having a front, a rear, a bottom, and opposing sides defining an interior and an open top end, said front, and opposing sides having top edges adjacent said open end;

a lid member coupled to said main housing, said lid member being movable from an open position to a closed position with respect to said main housing, said lid member having first and second apertures;

a separate stopper member coupled to said lid member;

said stopper member having a first end received in said first aperture and a second end releasably received in said second aperture, said lid member being coupled to said main housing by a living hinge, further comprising closure means on said lid member to releasably hold said lid member in said closed position with respect to said main housing, and said lid member having an underside and said closure means comprising an inner wall and an outer wall forming a groove disposed on said underside of said lid member proximate the edges of said lid member, other than the edge adjacent said living hinge, said groove being in substantial linear alignment with said top edges of said front and opposing sides of said main housing, so that when said lid member is in said closed position, said groove frictionally engages said top edges to releasably hold said lid member is said closed position.

2. A carrier for holding a drink container, the drink container having a parallelepiped shape with a top having a sealed punctuable orifice, said carrier comprising:

a main housing having a front, a rear, a bottom, and opposing sides defining an interior and an open top end, said front, rear, and opposing sides having edges adjacent said open end;

a lid member coupled to said main housing, said lid member being movable from an open position to a closed position with respect to said main housing, said lid member having first and second apertures;

a separate stopper member coupled to said lid member;

said stopper member having a first end received in said first aperture and a second end releasably received in said second aperture, and further comprising means for releasably holding a drinking straw in said interior of said main housing.

3. The carrier of claim 2, and said front, rear and sides forming four corners in said interior of said main housing, and said means for releasably holding a drinking straw comprising secondary ribs extending into the interior of said main housing to form, in cooperation with one of said corners, a space into which the drinking straw fits.

4. A carrier for holding a drink container, the drink container having the shape of a rectangular parallelepiped with a top having a sealed punctuable orifice, said carrier comprising a main housing having a front, rear, bottom, and opposing sides defining an interior and an open top end with top edges, drink-container support means for securely positioning and supporting a drink container within said housing in a spaced apart position relative to said front, rear, opposing sides, and bottom, lid means hingedly coupled to said main housing for removably closing said open end, stopper means coupled to said lid means for removably stoppering the orifice of a drink container supported within said housing, said lid member being coupled to said main housing by a living hinge, further comprising closure means on said lid member to releasably hold said lid member in said closed position with respect to said main housing, and said lid member having an underside and said closure means comprising an inner wall and an outer wall forming a groove disposed on said underside of said lid member proximate the edges of said lid member, other than the edge adjacent said living hinge, said groove being in substantial linear alignment with said top edges of said front and opposing sides of said main housing, so that when said lid member is in said closed position, said groove fractionally engages said top edges to releasably hold said lid member in said closed position.

5. A carrier for holding a drink container, the drink container having the shape of a rectangular parallelepiped with a top having a sealed punctuable orifice, said carrier comprising a main housing having a front, rear, bottom, and opposing sides defining an interior and an open top end, drink container support means for securely positioning and supporting a drink container within said housing in a spaced apart position relative to said front, rear, opposing sides, and bottom, lid means hingedly coupled to said main housing for removably closing said open end, stopper means coupled to said lid means for removably stoppering the orifice of a drink container supported within said housing, and further comprising means for releasably holding a drinking straw in said interior of said main housing.

6. The carrier of claim 5, and said front, rear and sides forming four corners in said interior of said main housing, and said means for releasably holding a drinking straw comprising secondary ribs extending into the interior of said main housing to form, in cooperation with one of said corners, a space into which the drinking straw fits.

7. A carrier for holding a drink container having the shape of a parallelepiped with a top having a sealed puncturable orifice, said carrier comprising:

a main housing having a front, a rear, a bottom, and opposing sides defining an interior and one open end, said front, rear, and opposing sides forming four corners in the interior of said main housing and having top edges adjacent said open end, said bottom having one or more holes, and said front and rear being convexly curved, a plurality of spaced, substantially L-shaped longitudinal ribs disposed on said interior thereof and positioned to support a drink container, a lid member coupled to said main housing by a living hinge, said lid member being movable from an open position to a closed position with respect to said main housing, said lid member having an underside, and first and second apertures, wherein said second aperture is positioned to align with the orifice of the drink container when the drink container has been inserted upright in said main housing and when said lid member is in said closed position with respect to said main housing, a separate stopper member coupled to said lid member, said stopper member having a first end received in said first aperture, and a second end releasably received in said second aperture wherein said second end has means to puncture and releasably seal the orifice of the drink container, wherein said first end cooperates with said first aperture to provide means to allow said second end to be moved to and from a puncturing and sealing position with respect to the orifice of the drink container, closure means comprising an inner wall and an outer wall forming a groove disposed on said underside of said lid member proximate the edges of said lid member, other than the edge adjacent said living hinge, said groove being in substantial linear alignment with said top edges of said front and opposing sides of said main housing, so that when said lid member is in said closed position, said groove frictionally engages said top edges to releasably keep said lid member in said closed position, and drinking straw holding means for releasably holding a straw in said interior of said main housing, said drinking straw means comprising secondary ribs extending into said interior of said main housing in cooperation with one of said corners to form a space into which the drinking straw fits.

* * * * *